US005517464A

United States Patent [19]

Lerner et al.

[11] Patent Number: 5,517,464

[45] Date of Patent: May 14, 1996

[54] INTEGRATED MODULATOR AND TURBINE-GENERATOR FOR A MEASUREMENT WHILE DRILLING TOOL

[75] Inventors: Daniel Lerner; Peter Masak, both of Missouri City, Tex.

[73] Assignee: Schlumberger Technology Corporation, Sugar Land, Tex.

[21] Appl. No.: 238,105

[22] Filed: May 4, 1994

[51] Int. Cl.[6] ..... H04H 9/00; G01V 3/00

[52] U.S. Cl. ..... 367/84; 175/45; 340/854.3

[58] Field of Search ..... 367/84, 83; 340/854.3; 175/45

[56] References Cited

U.S. PATENT DOCUMENTS

| | | | |
|---|---|---|---|
| 4,147,223 | 4/1979 | Patton . | |
| 4,189,705 | 2/1980 | Pitts, Jr. | 340/854.3 |
| 4,562,560 | 12/1985 | Kamp | 367/83 |
| 4,647,853 | 3/1987 | Cobern | 175/45 |
| 4,675,852 | 6/1987 | Russell et al. | 367/84 |
| 4,691,203 | 9/1987 | Rubin et al. | 340/854.3 |
| 4,734,892 | 3/1988 | Kotlyar | 367/83 |
| 4,839,870 | 6/1989 | Scherbatskoy | 367/83 |
| 4,847,815 | 7/1989 | Malone | 367/84 |
| 4,914,433 | 4/1990 | Galle | 340/854.3 |
| 4,914,637 | 4/1990 | Goodsman . | |
| 4,956,823 | 9/1990 | Russell et al. | 367/84 |
| 4,979,112 | 12/1990 | Ketcham | 367/83 |
| 5,073,877 | 12/1991 | Jeter | 367/84 |
| 5,146,433 | 9/1992 | Kosmala et al. | 367/83 |
| 5,182,731 | 1/1993 | Hoelscher et al. . | |
| 5,197,040 | 3/1993 | Kotlyar . | |
| 5,237,540 | 8/1993 | Malone | 367/84 |
| 5,249,161 | 9/1993 | Jones et al. | 367/84 |
| 5,357,483 | 10/1994 | Innes . | |
| 5,375,098 | 12/1994 | Malone et al. | 367/84 |

*Primary Examiner*—Charles T. Jordan
*Assistant Examiner*—Theresa M. Wesson
*Attorney, Agent, or Firm*—David P. Gordon; Wayne I. Kanak

[57] ABSTRACT

An integrated modulator and turbine-generator includes a turbine impeller which is directly coupled by a drive shaft to a modulator rotor downstream from the impeller. The modulator rotor is further coupled by a drive shaft and a gear train to a three phase alternator downstream of the modulator rotor. The modulator stator blades are arranged downstream of and adjacent to the modulator rotor and the alternator is provided with a Hall effect tachometer. The turbine impeller directly drives the modulator rotor and the alternator generates power. The speed of rotation of the modulator rotor is adjusted by reference to the speed of rotation of the alternator as indicated by the tachometer and to a reference frequency. A control circuit including an electromagnetic braking circuit coupled to the tachometer and the stator windings of the alternator stabilizes the alternator speed and thus the rotor speed and modulates the rotor to obtain the desired frequency of the mudborne pressure wave by selectively shorting the stator windings of the alternator. During periods when braking is not applied, the alternator generates power for control and sensor electronics.

28 Claims, 8 Drawing Sheets

INTEGRATED MODULATOR AND TURBINE-GENERATOR FOR A MEASUREMENT WHILE DRILLING TOOL

BACKGROUND OF THE INVENTION

1. Field of the Invention

The invention relates to the transmission of data acquired by a measurement while drilling (MWD) tool during the drilling of a wellbore and to the generation of electrical power to operate an MWD tool. More particularly, the invention relates to an integral mud flow telemetry modulator and turbine-generator for simultaneously generating continuous wave pressure signals while generating power for the modulator and for an electronic sensor package of an MWD tool.

2. State of the Art

Modern well drilling techniques, particularly those concerned with the drilling of oil and gas wells, involve the use of several different measurement and telemetry systems to provide data regarding the formation and data regarding drilling mechanics during the drilling process. In MWD tools, data is acquired by sensors located in the drill string near the bit. This data is either stored in downhole memory or transmitted to the surface using mud flow telemetry devices. Mud flow telemetry devices transmit information to an uphole or surface detector in the form of acoustic pressure waves which are modulated through the drilling fluid (mud) that is normally circulated under pressure through the drill string during drilling operations. A typical modulator is provided with a fixed stator and a motor driven rotatable rotor each of which is formed with a plurality of spaced apart lobes. Gaps between adjacent lobes present a plurality of openings or ports for the mud flow stream. When the ports of the stator and rotor are in direct alignment, they provide the greatest passageway for the flow of drilling mud through the modulator. When the rotor rotates relative to the stator, alignment between the respective ports is shifted, interrupting the flow of mud to generate pressure pulses in the nature of acoustic signals. By selectively varying the rotation of the rotor to produce changes in the acoustic signals, modulation in the form of encoded pressure pulses is achieved. Various means are employed to regulate the rotation of the rotor.

Both the downhole sensors and the modulator of the MWD tool require electric power. Since it is not feasible to run an electric power supply cable from the surface through the drill string to the sensors or the modulator, electric power must be obtained downhole. The state of the art MWD devices obtain such power downhole either from a battery pack or a turbine-generator. While the sensor electronics in a typical MWD tool may only require 3 watts of power, the modulator typically requires at least 60 watts and may require up to 700 watts of power. With these power requirements, it has become common practice to provide a mud driven turbine-generator unit in the drill string downstream of the modulator with the sensor electronics located between the turbine and the modulator.

The drilling mud which is used to power the downhole turbine-generator and which is the medium through which the acoustic pressure waves are modulated, is pumped from the surface down through the drill string. The mud exits the drill bit where it acts as a lubricant and a coolant for drilling and is forced uphole through the annulus between the borehole wall and the drill string. As the mud flows downhole through the drill string it passes through the telemetry modulator and the turbine-generator. As mentioned above, the modulator is provided with a rotor mounted on a shaft and a fixed stator defining channels through which the mud flows. Rotation of the rotor relative to the stator acts like a valve to cause pressure modulation of the mud flow. The turbine-generator is provided with turbine blades (an impeller) which are coupled to a shaft which drives an alternator. Jamming problems are often encountered with turbine powered systems. In particular, if the modulator jams in a partially or fully closed position because of the passage of solid materials in the mud flow, the downstream turbine will slow and reduce the power available to the modulator. Under reduced power, it is difficult or impossible to rotate the rotor of the modulator. Thus, while turbines generally provide ample power, they can fail due to jamming of the modulator. While batteries are not subject to power reduction due to jamming of the modulator, they produce less power than turbine-generators and eventually fail. In either case, therefore, conservation of downhole power is a prime concern.

U.S. Pat. No. 4,914,637 to Goodsman discloses a pressure modulator controlled by a solenoid actuated latching means which has relatively low power requirements. A stator with vanes is located upstream of a rotor having channels. As mud flows and passes over the vanes, the vanes impart a swirl to the mud which accordingly applies a torque to the rotor as the mud passes through the channels in the rotor. The rotor is prevented from rotating by a solenoid actuated latching device having a number of pins and detents. When the solenoid is energized, a pin is freed from a detent and the rotor is free to rotate through an angle of 45 degrees whereupon it is arrested by another pin and detent. When the rotor is arrested, it occludes the flow of mud until the solenoid is activated once again. Occlusion of the mud flow causes a pressure pulse which is detectable at the surface. The power requirement of Goodsman's modulator (approximately 10 watts) is low enough to be met by a downhole battery pack. However, since Goodsman's modulator is not motor driven, but rather mud flow driven, it depends on the hydraulic conditions of the drilling fluid which may vary considerably. Thus, the torque acting on the rotor will vary and interfere with signal generation. Moreover, in many instances, the torque is so great that undue strain is placed on the latching device subjecting it to severe wear and early failure.

A different approach to downhole energy conservation is disclosed in U.S. Pat. No. 5,182,731 to Hoelscher et al. The rotation of the rotor of the modulator is limited to two positions by fixed stops on the stator so that it can only rotate through an angle necessary to open or close the mud flow ports. A reversible D.C. motor coupled to the rotor is used to rotate the rotor to the open or closed position. A switching circuit coupled to the motor can also be used to brake the motor by shorting the current generated by the motor as it freely rotates. Power is conserved according to the theory that the on-duration of the motor is always relatively short.

In addition to considerations of power requirements, modulator design must also be concerned with the telemetry scheme which will be used to transmit downhole data to the surface. The mud flow may be modulated in several different ways, e.g. digital pulsing, amplitude modulation, frequency modulation, or phase shift modulation. Goodman's modulator achieves its energy efficiency in part by using amplitude modulation. Unfortunately, amplitude modulation is very sensitive to noise, and the mud pumps at the surface, as well as pipe movement, generate a substantial amount of noise. When the modulated mud flow is detected at the surface for reception of data transmitted from downhole, the noise of the mud pumps presents a significant obstacle to accurate demodulation of the telemetry signal. Hoelscher's modulator relies on digital pulsing which, while less sensitive to noise, provides a slow data transmission rate. Digital pulsing of the mud flow can achieve a data transmission rate of only about one bit per second. Comparatively, a modulated carrier wave signal can achieve a transmission rate of up to eight bits per second.

SUMMARY OF THE INVENTION

It is therefore an object of the invention to provide a mud flow modulator which conserves energy without sacrificing other operational characteristics.

It is also an object of the invention to provide a mud flow modulator which runs continuously and modulates a carrier wave.

It is another object of the invention to provide a mud flow modulator which uses a telemetry scheme which is inherently insensitive to noise.

It is also an object of the invention to provide a mud flow modulator which is self powered but which is not totally dependent on the hydraulics of the mud flow.

It is still another object of the invention to provide a turbine-generator for powering MWD sensor electronics which will not slow if the mud flow modulator jams.

It is also an object of the invention to provide a mud flow modulator which has an enhanced startup torque to resist jamming and to recover from jamming.

It is still another object of the invention to provide a simple circuit for regulating the speed of the rotor in a mud flow modulator, and simultaneously provide power.

It is a further object of the invention to provide a mud flow modulator having a rotor which requires only gentle accelerations and decelerations in order to modulate a carrier wave.

In accord with these objects which will be discussed in detail below, the integrated modulator and turbine-generator of the present invention includes a turbine impeller which is directly coupled by a drive shaft to a modulator rotor downstream from the impeller. The modulator rotor is further coupled by a drive shaft and a gear train located downstream of the modulator rotor to an alternator which is provided with a Hall effect tachometer. With the provided arrangement, the turbine impeller directly drives the modulator rotor. The speed of rotation of the modulator rotor is adjusted by reference to the speed of rotation of the alternator as indicated by the tachometer. A feedback control circuit including an electromagnetic braking circuit coupled to the tachometer and the alternator stabilizes the alternator speed and thus the rotor speed and modulates the rotor to obtain the desired pressure wave frequency in the mud. During periods of braking, a charged capacitor provides power to the sensor and control electronics. Preferred aspects of the invention include: using a three phase alternator; coupling the alternator to the drive shaft through a 14:1 gear train so that the alternator rotates much faster than the drive shaft; supplying a reference frequency for comparison with the speed indicated by the tachometer; and modulating the alternator speed by dividing the reference frequency according to a signal from a downhole sensor package. Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
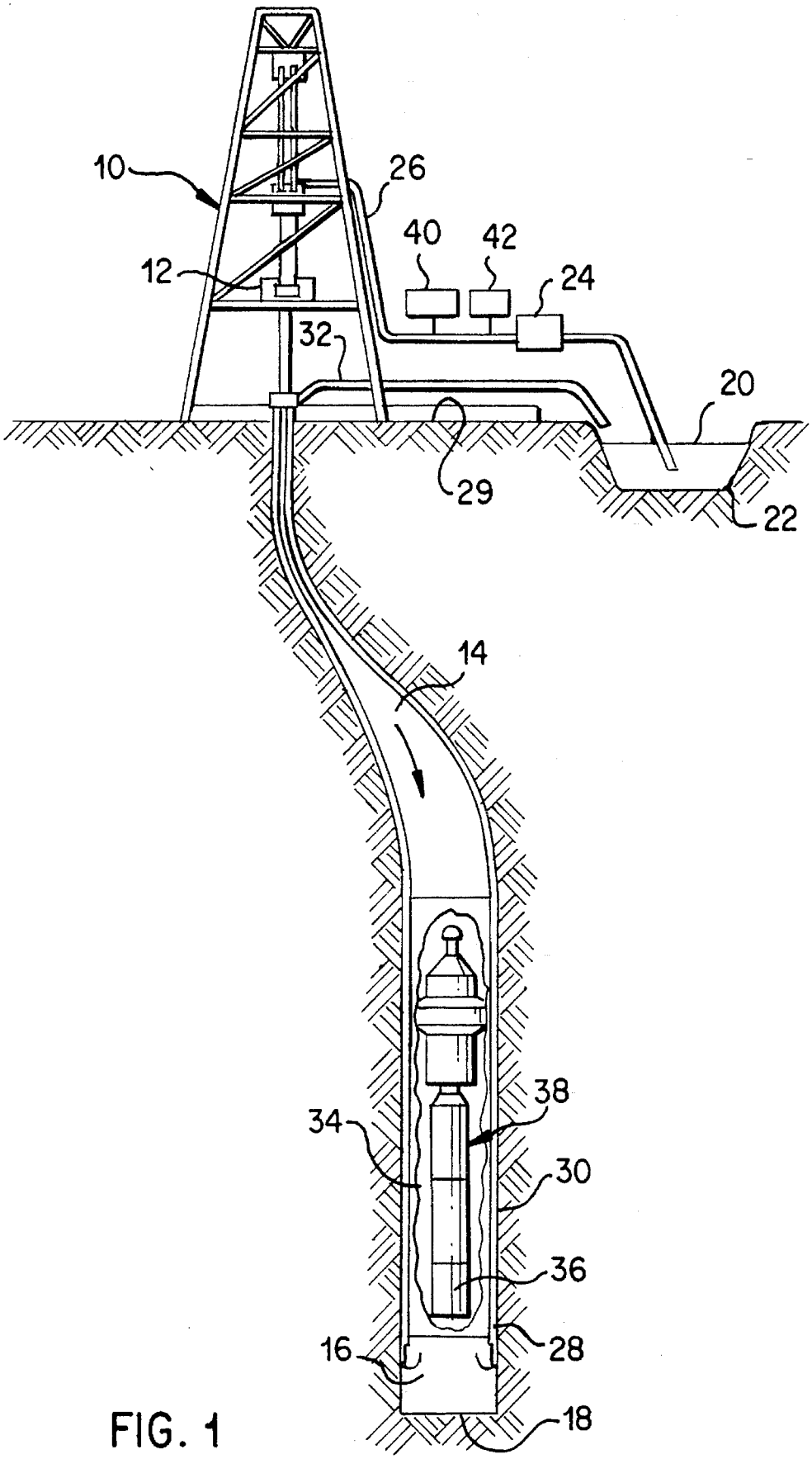
FIG. 1 is a schematic diagram of an MWD tool in its typical drilling environment.

Referring now to FIG. 1, a drilling rig 10 is shown with a drive mechanism 12 which provides a driving torque to a drill string 14. The lower end of the drill string 14 carries a drill bit 16 for drilling a hole in an underground formation 18. Drilling mud 20 is picked up from a mud pit 22 by one or more mud pumps 24 which are typically of the piston reciprocating type. The mud 20 is circulated through a mud line 26 down through the drill string 14, through the drill bit 16, and back to the surface 29 via the annulus 28 between the drill string 14 and the wall of the well bore 30. Upon reaching the surface 29, the mud 20 is discharged through a line 32 back into the mud pit 22 where cuttings of rock and other well debris settle to the bottom before the mud is recirculated.

As is known in the art, a downhole MWD tool 34 can be incorporated in the drill string 14 near the bit 16 for the acquisition and transmission of downhole data. The MWD tool 34 includes an electronic sensor package 36 and a mud flow telemetry device 38. The mud flow telemetry device 38 selectively blocks passage of the mud 20 through the drill string 14 thereby causing changes in pressure in the mud line 26. In other words, the telemetry device 38 modulates the pressure in the mud 20 in order to transmit data from the sensor package 36 to the surface 29. Modulated changes in pressure are detected by a pressure transducer 40 and a pump piston position sensor 42 which are coupled to a processor (not shown). The processor interprets the modulated changes in pressure to reconstruct the data sent from the sensor package 36. It should be noted here that the modulation and demodulation of the pressure wave are described in detail in commonly assigned application Ser. No. 07/934,137 which is incorporated herein by reference.

Figure 2:
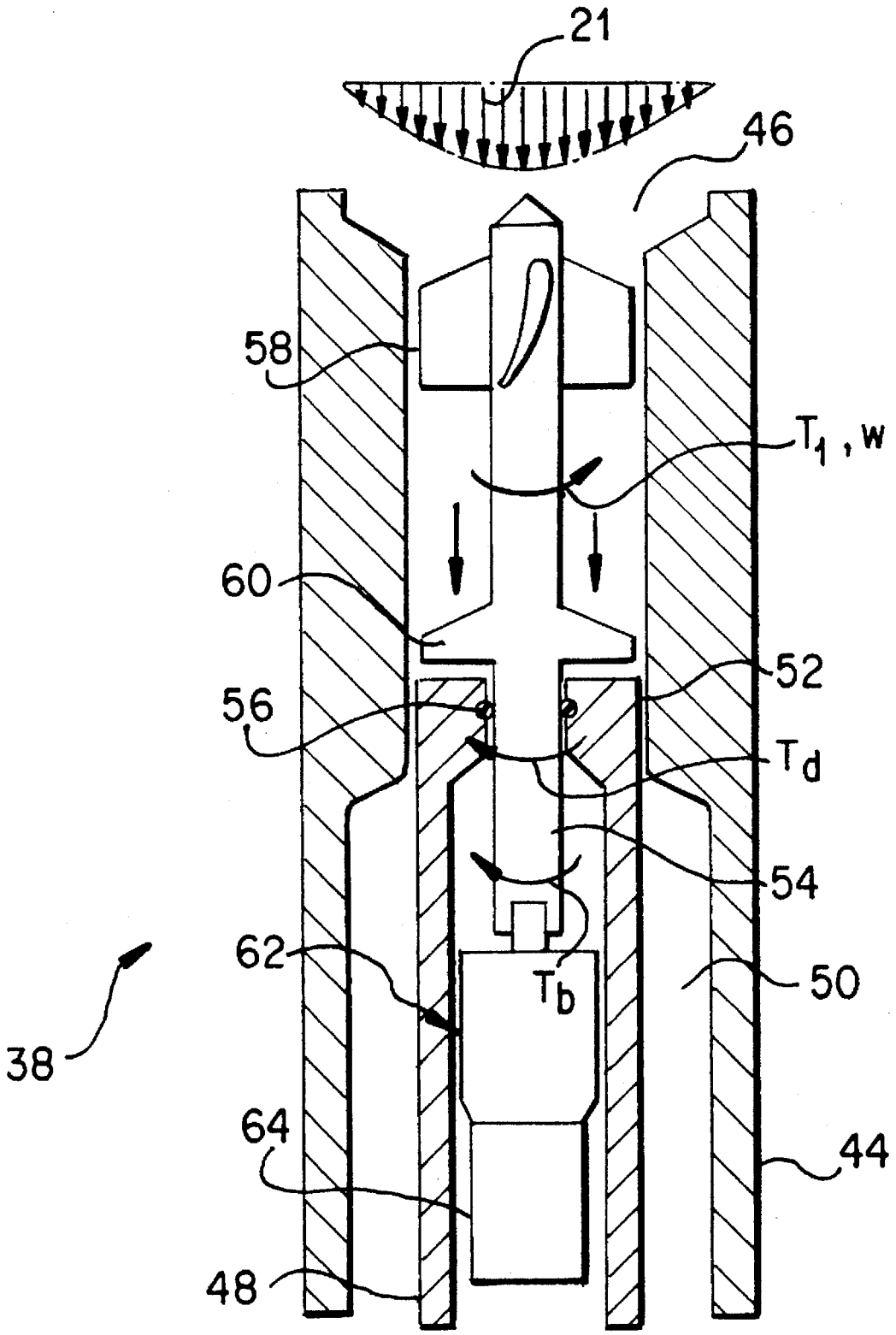
FIG. 2 is a conceptual schematic cross sectional view of the integrated modulator and turbine-generator of the invention.

Turning now to FIG. 2, the mud flow telemetry device 38 according to the invention includes a sleeve 44 having an upper open end 46 into which the mud flows in a downward direction as indicated by the downward arrow velocity profile 21 in FIG. 2. A tool housing 48 is mounted within the flow sleeve 44 thereby creating an annular passage 50. The upper end of the tool housing 48 carries modulator stator blades 52. A drive shaft 54 is centrally mounted in the upper end of the tool housing by sealing bearings 56. The drive shaft 54 extends both upward out of the tool housing 48 and downward into the tool housing 48. A turbine impeller 58 is mounted at the upper end of the drive shaft 54 just downstream from the upper open end 46 of the sleeve 44. A modulator rotor 60 is mounted on the drive shaft 54 downstream of the turbine impeller 58 and immediately upstream of the modulator stator blades 52. The lower end of the drive shaft 54 is coupled to a 14:1 gear train 62 which is mounted within the tool housing 48 and which in turn is coupled to an alternator 64. The alternator 64 is mounted in the tool housing 48 downstream of the gear train 62.

Figure 2A:
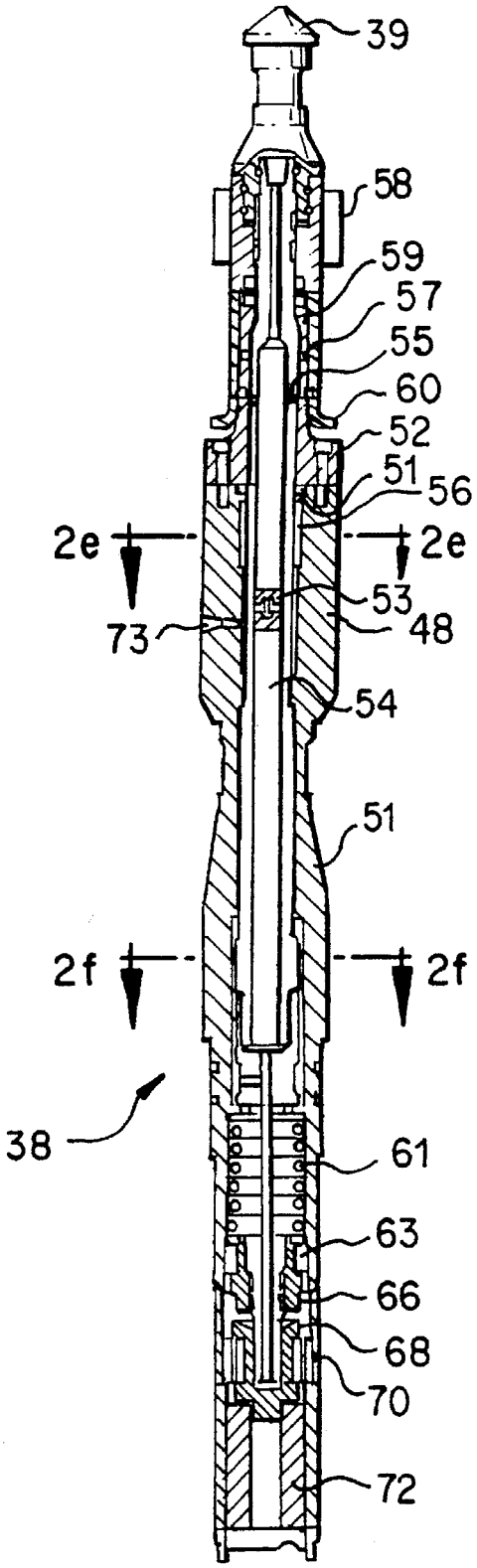
FIGS. 2*a* through 2*d* are broken longitudinal cross sectional views of an MWD tool according to the invention.
Figure 2B:
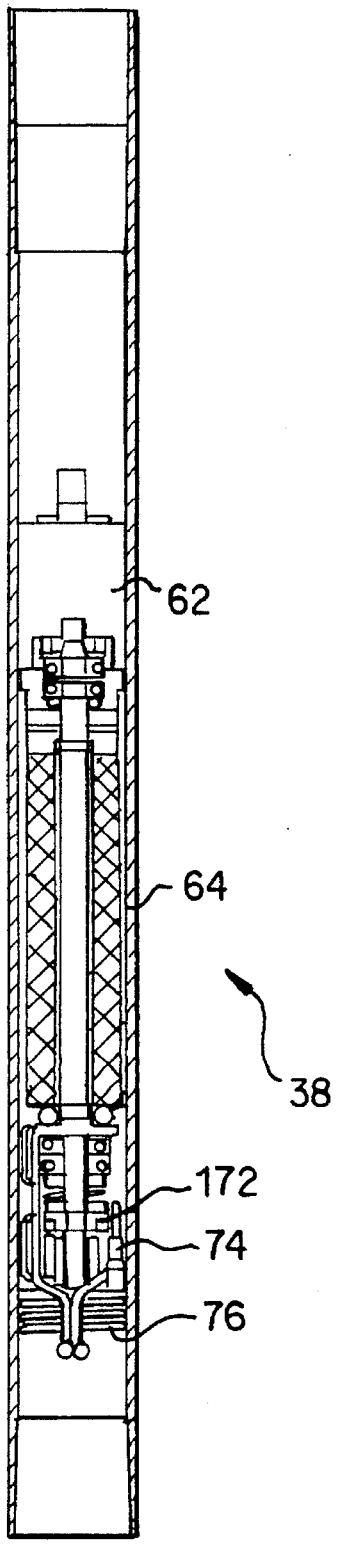
Figure 2C:
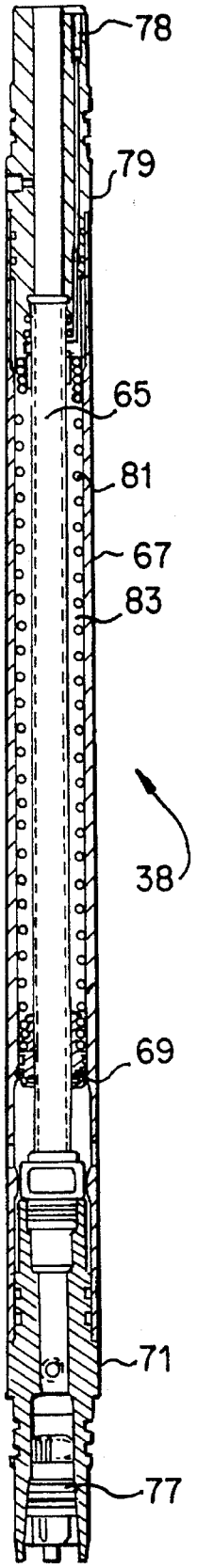

As shown in FIGS. 2*a* through 2*d*, the top of the telemetry device 38 is typically provided with a standard spear point 39 for raising and lowering the tool through a drill string. The modulator rotor 60 is coupled to the drive shaft 54 with a taper collar 59, a preload spring 57, and a face seal 55. The modulator stator 52 is coupled to the tool housing 48 with a polypack seal 51 surrounding the drive shaft 54. The drive shaft 54 is also provided with a compensator piston 53 as shown in FIG. 2*a*. The tool housing 48 is further provided with a webb reducer 51 downstream of the stator 52. The lower end of the drive shaft 54 is provided with angular contact bearings 61, and preload nuts 63 and 66. The drive shaft 54 is coupled via a magnetic positioner rotor 68 and a helical flexible shaft coupling 72 to the gear train 62 (FIG. 2*b*). A magnetic positioner stator 70 is arranged adjacent to the magnetic position rotor 68. The lower end of the alternator 64 is coupled to a magnet housing 172 which rotates inside a tachometer coil housing 74 which is held in place by preload springs 76.

Figure 2D:
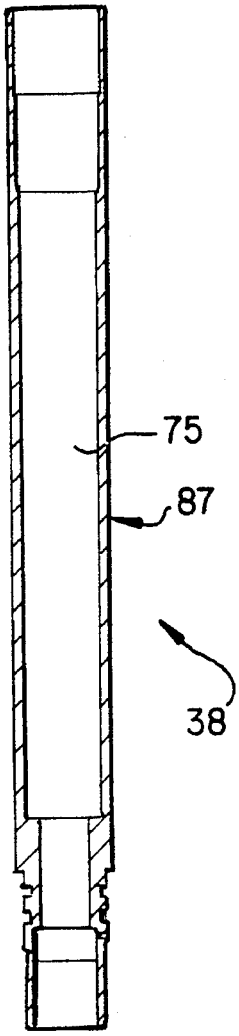
Figure 2E:
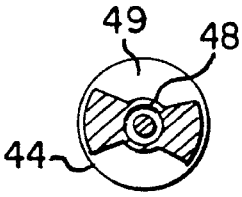
FIG. 2*e* is a cross sectional view of the tool of FIG. 2*a* along the line 2*e*—2*e* and showing the sleeve from FIG. 2.
Figure 2F:
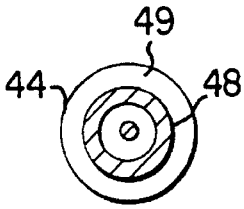
FIG. 2*f* is a cross sectional view of the tool of FIG. 2*a* along the line 2*f*—2*f* and showing the sleeve from FIG. 2.

To minimize the stresses induced by the pressure differentials across the tool housing 48, the mechanical assembly is filled with oil. A compensator housing 67 (FIG. 2*c*) is located downstream of the alternator 64 and includes a check valve 78, an adapter 79, and a compensator shaft 65. The compensator shaft 65 is surrounded by an extension spring 81 and an oil reservoir 83. A compensator piston 69 surrounds the lower end of the compensator shaft 65 and engages one end of the extension spring 81. A connector housing 71 is located downstream of the compensator housing 67 and is provided with an oil fill port 73 and a high pressure connector 77. The pressure compensator provides room for oil expansion and contraction due to pressure and temperature changes. The sensor electronics 75 are mounted downstream of the connector housing 71 in the electronics housing 87 as shown in FIG. 2*d*. FIGS. 2*e* and 2*f* show the mud flow path 49 between the tool housing 48 and the sleeve 44 at two points along the telemetry device 38.

Figure 3:
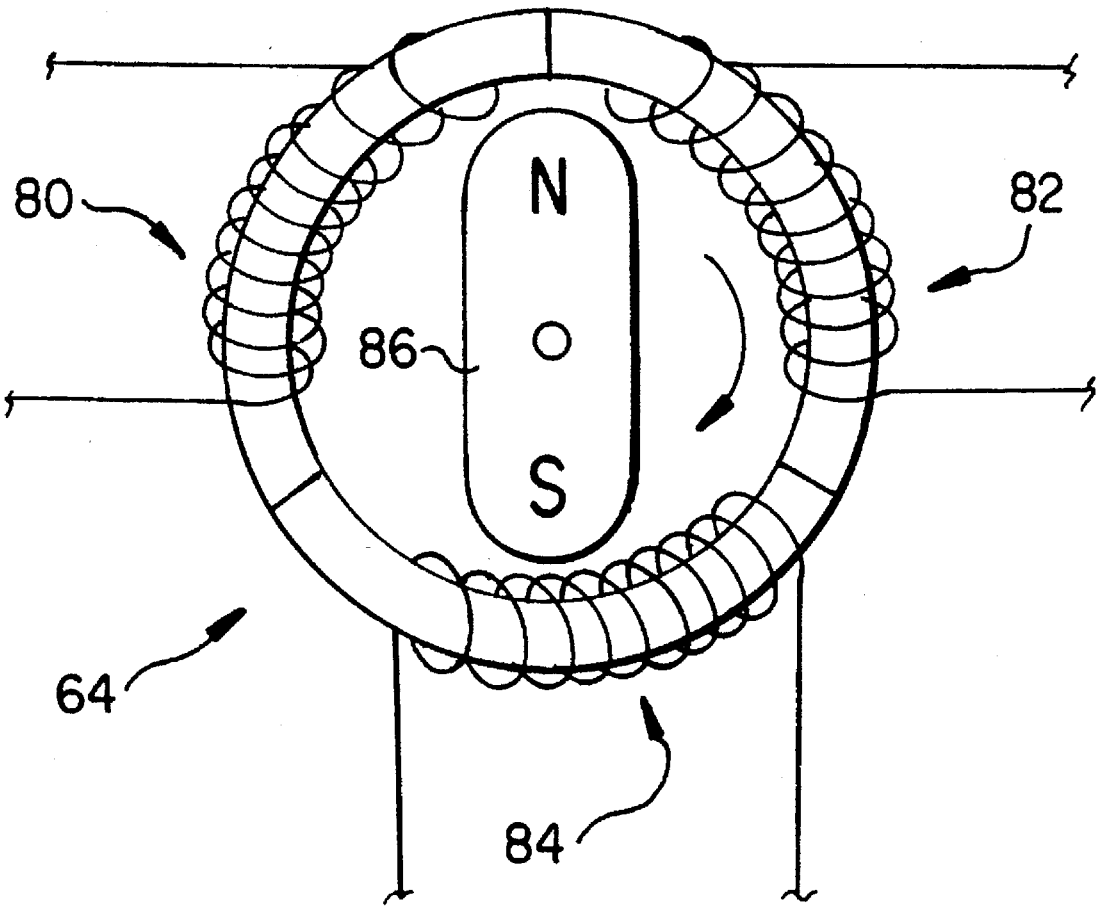
FIG. 3 is a schematic diagram of a three phase alternator.
Figure 3A:
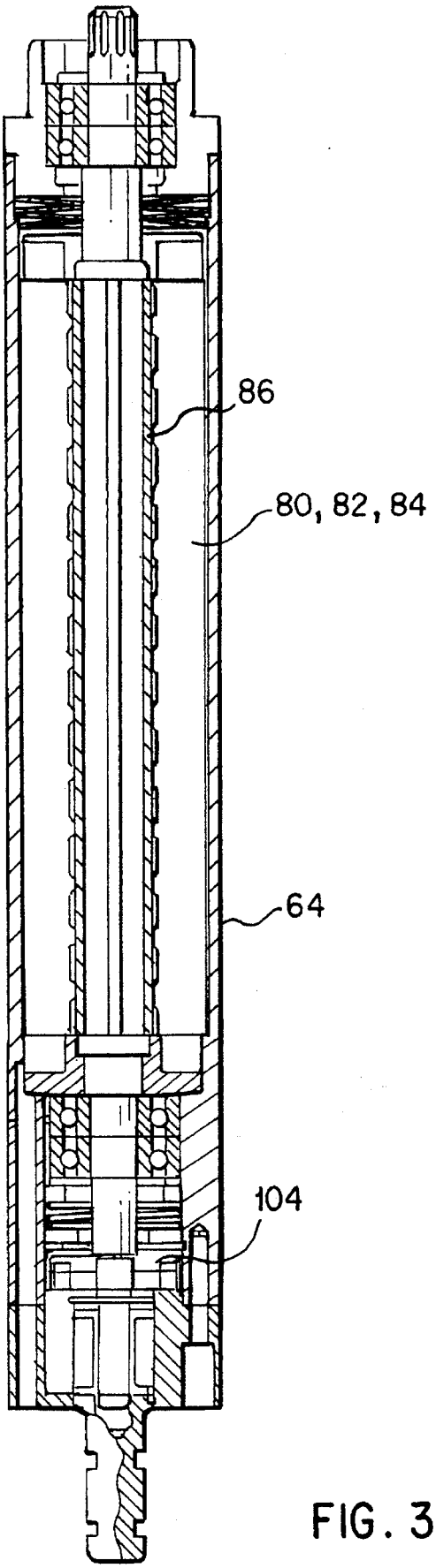
FIG. 3*a* is a longitudinal cross sectional view of the three phase alternator of the invention.
Figure 4:
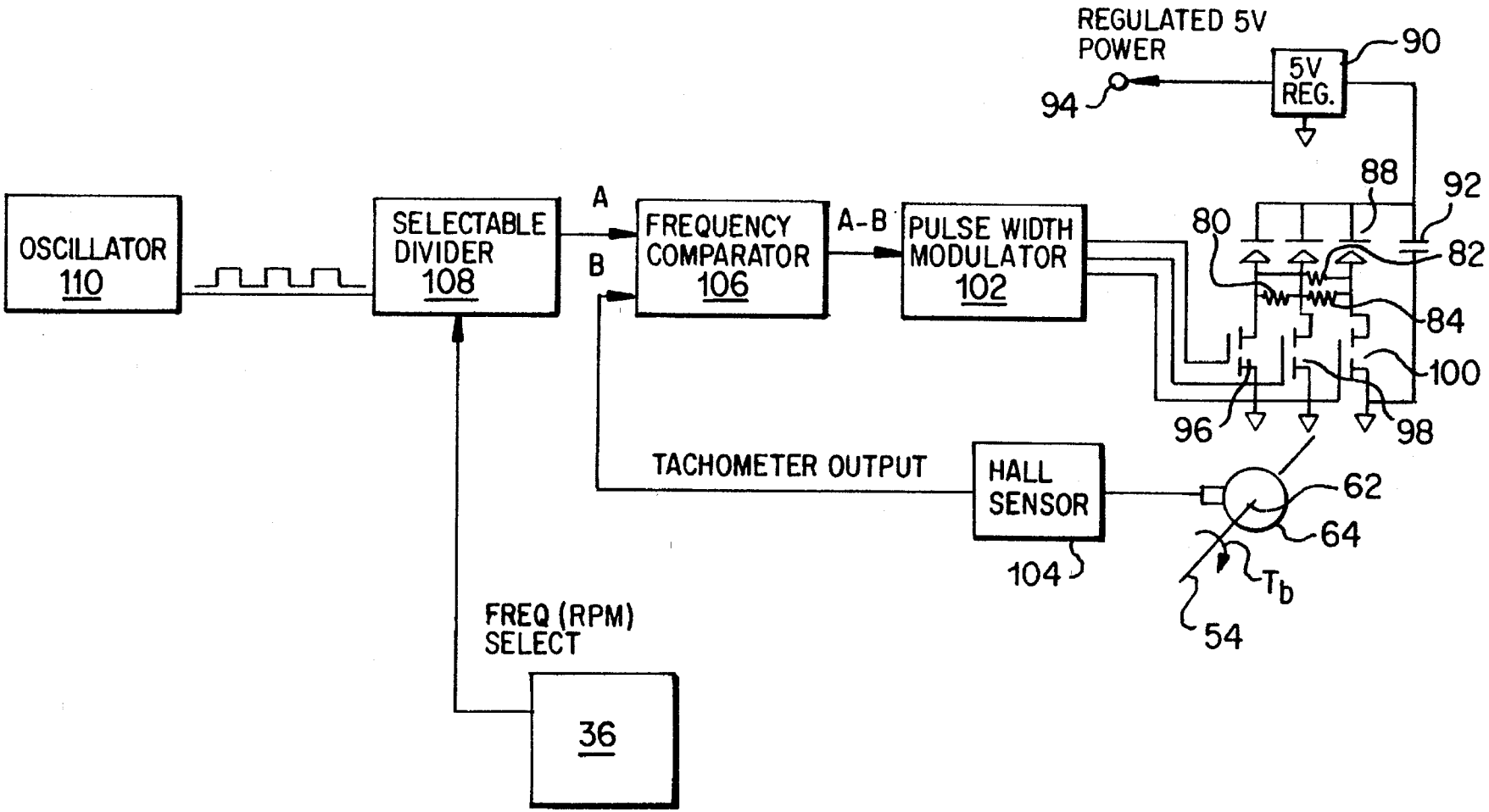
FIG. 4 is a schematic diagram of a control circuit according to the invention.

Referring once again to FIG. 2, as the mud 20 enters the upper end of the tool housing 48 it engages the impeller 58 which is designed to rotate as a result thereof. The rotation of the impeller 58 imparts a torque $T_1$ (in*lb) and an angular velocity w (RPM) to the drive shaft 54. This torque is sufficient to overcome the drag torque $T_d$ in the bearings 56 and the gear train 62. Due to the 14:1 gear train 62, the rotation speed of the alternator 64 is fourteen times faster than the rotation of the drive shaft 54. A braking mechanism, which is preferably electronic as described in detail below with reference to FIGS. 3, 3*a* and 4, is coupled to the alternator 64 and used to regulate the rotation speed of the alternator 64 and thus the drive shaft 54 by applying a braking torque $T_b$ to the drive shaft 54. Those skilled in the art will appreciate that regulation of the rotation speed of the drive shaft 54 consequently effects a regulation of the rotation speed of the modulator rotor 60, thereby effecting changes in pressure in the mud line 26 to create the acoustic wave upon which downhole data is modulated. It will further be appreciated that in order to properly modulate the pressure in the mud line 26, the speed of the drive shaft 54 and the alternator 64 must be accurately regulated. Moreover, regulation must be accurate over a range of mud flow rates and mud densities which affect the torque and power generated by the turbine impeller 58.

For a given flow rate, the torque $T_1$ generated by the turbine impeller 58 will be inversely proportional to the angular velocity w of the drive shaft 54, according to:

$$T_1=(m_1*w)+T_0-T_d \tag{1}$$

where $m_1$ is a negative constant of proportionality relating the angular velocity of the impeller to the torque it generates, and $T_0$ is the stall torque (the maximum torque at 0 RPM). With a torque of $T_1$, the power $P_1$ (watts) delivered through the drive shaft 54 by the turbine impeller 58 is:

$$P_t=\frac{T_1 * w}{84.5} \tag{2}$$

where 84.5 is a units conversion factor to convert in*lb*RPM to watts. For different flow rates, the constant $m_1$ remains unchanged. However, the stall torque $T_0$ increases quadratically with increasing flow rate Q (GPM) and linearly with the density ρ (lb/gal) of the drilling fluid (mud) 20. Thus, the stall torque $T_0$ is defined according to:

$$T_0=n*Q^2*\rho \tag{3}$$

where n is a constant of proportionality (in*lb/GPM) relating stall torque to flow rate. Combining equations (1) through (3), the power $P_1$ from the turbine at any flow rate Q and mud density ρ may be expressed as:

$$P_t=\frac{w * [(m_1 * w) + (n * Q^2 * \rho) - T_d]}{84.5} \tag{4}$$

Similarly, the electromagnetic braking torque $T_b$ of the alternator 64 increases proportionally to the angular velocity w of the drive shaft 54 according to the equation $$T_b=(m_2*w)*GR*x*e \tag{5}$$

where $m_2$ is a positive constant of proportionality relating braking torque to angular velocity, GR is the gear ratio of the gear train 62, x is the braking duty cycle, and e is the gear train efficiency. Consequently, the power $P_b$ dissipated during electromagnetic braking is $$P_b=\frac{[(m_2 * w) * GR * x * e] * w}{84.5} \tag{6}$$

The amount of braking (duty cycle) may vary from $0 \leqq x \leqq 1$, where 0 represents no braking and 1 represents 100% braking. It will be appreciated that when the amount of braking x=1, the braking power $P_b$ should be equal to the power $P_1$ generated by the turbine impeller, thereby placing the modulator rotor in equilibrium. It is therefore necessary to choose a turbine impeller which can drive the gear train and alternator, and an alternator (electromagnetic brake) which can deliver sufficient braking power $P_b$ at different flow rates and drilling fluid densities. By equating equations (4) and (6) and solving for x, the amount of braking of the alternator can be expressed as follows:

$$x = \frac{(m_1 * w) + (n * Q^2 * \rho) - T_d}{m_2 * w * GR * e} \quad (7)$$

The usable operating range of the alternator will be established as a range of flow rates Q. For example, the maximum flow rate which can be tolerated by the alternator when x=1 can be expressed as:

$$Q_{max} = \sqrt{\frac{w(m_2 * GR * e - m_1) + T_d}{n * \rho}} \quad (8)$$

Similarly, the minimum flow rate needed by the turbine impeller to drive the drive shaft is established when the amount of braking x=0 and can be expressed as:

$$Q_{min} = \sqrt{\frac{T_d - (m_1 * w)}{n * \rho}} \quad (9)$$

As a practical example, where $m_1$=−3.75*$10^{-3}$ in*lb/RPM, $m_2$=3.443*$10^{-3}$ in*lb/RPM, n=2.614*$10^{-5}$ in*lb/GPM, e=0.70, ρ=8.5 lb/gal, $T_d$=3 in*lb and GR=13.88: $Q_{min}$=145 gpm and $Q_{max}$=564 gpm at approximately 510 RPM. Those skilled in the art will appreciate that it is desirable to provide a turbine impeller and an electromagnetic braking device which covers the broadest flow range possible, perhaps from 100 to 1000 gpm. The maximum flow rate which can be tolerated by the alternator can be maximized by selecting a large gear ratio and a gear train having a high efficiency, i.e. by maximizing GR and e. In addition, the constant of proportionality $m_2$ which relates to the braking torque from the alternator versus its rotational speed can be maximized by selecting a large alternator with tight clearances between stator and rotor. The minimum flow rate needed by the turbine impeller may be decreased by increasing the pitch angle of the turbine blades which results in greater output torque per unit flow rate and hence a higher value of the constant n. According to a presently preferred embodiment, the alternator is capable of dissipating up to 580 watts of power during braking.

Once the modulator rotor is in equilibrium, modulated pulses in the mud flow may be created by accurately varying the alternator speed through selective electromagnetic braking. As used herein, "selective braking" may mean continuous braking while varying the amount of braking, or it may mean selecting between braking and not braking as will be better understood from the description which follows. Typically, the alternator speed will be varied between two speeds, e.g. 7,140 RPM and 7,980 RPM which correlate with modulator rotor speeds of 510 RPM and 570 RPM respectively. The difference in the speeds is proportional to the desired bit rate, approximately 3.5% per bps. A modulator rotor having two lobes will generate an acoustic wave in the mud flow having a frequency within the preferred operating range of between 17 to 19 Hz when rotated at a speed between 510 and 570 RPM. This relationship is derived from the following equation:

$$f_{Hz} = \frac{w * lobes}{60} \quad (10)$$

One of the objects of the invention is to utilize a telemetry method which modulates a carrier wave in a noise resistant manner. It is generally known that frequency shift keying (FSK) and phase shift keying (PSK) modulation methods are abundantly more noise resistant than amplitude modulation (AM). Moreover, tests conducted by the applicants have demonstrated that FSK modulation can provide a data transfer rate several times faster than AM. In addition, a major advantage of an FSK system is that it does not require such severe motor accelerations and decelerations as are required in a PSK system. In order to further enhance the telemetry system according to the invention, a carrier frequency is chosen such that it avoids ambient noise frequencies such as those generated by the mud pumps.

Turning now to FIGS. 3, 3*a*, and 4, the alternator 64 according to the invention is shown as a three phase alternator having three stator windings 80, 82, 84 spaced 120 degrees apart and a permanent magnet rotor 86. Voltage is generated as a result of the rotating magnetic field cutting across the fixed stator windings. In the present invention, the rotor 86 is coupled via the gear train 62 to the drive shaft 54 which is driven by the turbine impeller 58 (FIG. 2). The rotor 86 is thus driven by the turbine impeller 58 and an output voltage is produced at the stator windings 80, 82, 84. The output of the stator windings 80, 82, 84 is rectified by diodes 88 (FIG. 4) and regulated by a voltage regulator 90 to provide a 5 V power source 94 to operate the semiconductor electronics of the MWD tool 34 and, optionally, to charge a capacitor 92. Stator windings 80, 82, and 84 are also coupled to three field effect transistors (FETs) 96, 98, 100 as shown in FIG. 4. These FETs selectively short windings 80, 82, 84 in order to electronically brake rotation of the rotor 86. For example, when FETs 96 and 98 are activated, stator winding 80 is shorted. When FETs 96 and 100 are activated, stator winding 82 is shorted, and when FETs 98 and 100 are activated, stator winding 84 is shorted. The FETs are each coupled to a pulse width modulator 102 which controls when and for what duration each FET will be active. Capacitor 92 provides power to the electronics when the FETs 96, 98, 100 are shorting the stator windings 80, 82, 84 to apply electromagnetic braking.

The desired speed of the alternator is determined by a microprocessor (not shown) associated with the sensor package 36. The desired speed is implemented by the feedback circuit of FIG. 4 which preferably includes an oscillator 110, a selectable frequency divider 108, a frequency comparator 106, a pulse width modulator 102, and a Hall effect sensor 104. In particular, the output signal of the microprocessor which controls the modulation frequency is a 5 V/0 V digital signal. The signal is used to control the selectable frequency divider 108. This is preferably accomplished by causing the selectable frequency divider to divide down the frequency of the oscillator 110 by a first value when the control signal is high (5 V), and by a second value when the control signal is low (0 V). As a result, the desired frequencies of the alternator are generated according to the preferred modulation scheme and sent as a first input to the frequency comparator 106. The second input to the frequency comparator 106 is the actual speed of the alternator as sensed by the Hall effect sensor 104. A difference signal which relates to the difference between the actual speed of the alternator and the desired speed of the alternator is provided by the frequency comparator 106 to the pulse width modulator 102. The pulse width modulator 102 effectively brakes the alternator by controlling the duration the FETs are on. When the FETs are on, they short the alternator windings, which allows a large current flow in the windings, limited by the winding resistance. The current flow causes a large electromagnetic braking torque on the alternator rotor. The power removed from the rotor is dissipated in the alternator windings. Thus, the desired alternator speed is effected. It will be appreciated that the "desired" alternator speed is typically changing based on the data which is to be transmitted.

It should further be appreciated that depending upon the modulation scheme utilized and the selectable divider utilized, the control signal provided by the microprocessor might change. For example, if multiple frequencies are required in the modulation scheme, the microprocessor might provide several different frequencies which would activate different divide down circuits in the selectable divider. Of course, other schemes could be utilized.

The described feedback circuit always shifts down the speed of rotation of the alternator (i.e., brakes the alternator) because the alternator will always be accelerated to an overspeed condition by the turbine through the gear train coupling. Moreover, neither the turbine nor the modulator are subject to jamming since the pressure of the mud flow will always cause the turbine to rotate because it is located upstream from the modulator. In addition, the energy dissipated by the electromagnetic braking is conducted in the form of heat through the alternator case and into the tool body. During periods when braking is not required (see FIGS. 5*a*–5*d* discussed hereinafter), the alternator generates power for the control and sensor electronics.

Figure 5A:
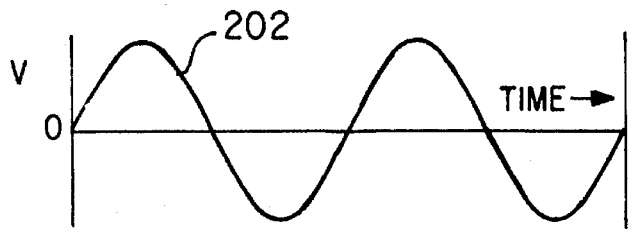
FIG. 5*a* is a graph showing the output voltage of the alternator when there is no braking.
Figure 5B:
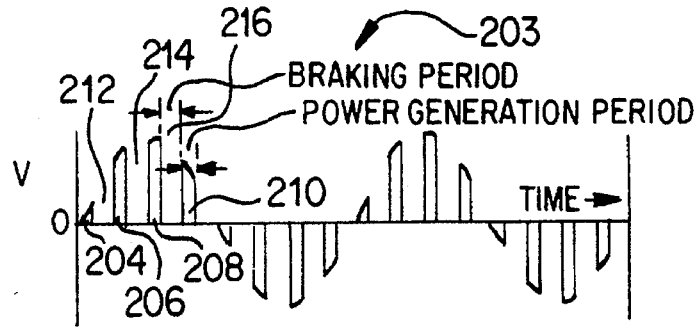
FIG. 5*b* is a graph showing the output voltage of the alternator when there is heavy braking and a high flow rate.
Figure 5C:
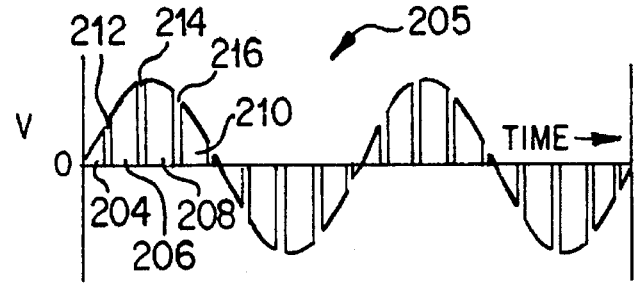
FIG. 5*c* is a graph showing the output voltage of the alternator when there is light braking and a low flow rate.
Figure 5D:
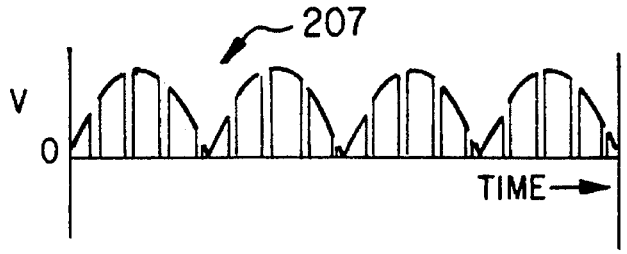
FIG. 5*d* is a graph showing the rectified output voltage of the alternator when there is light braking and a low flow rate.
Figure 5E:
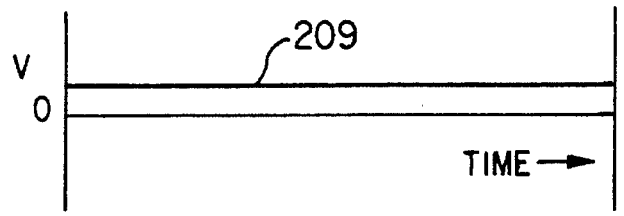
FIG. 5*e* is a graph of the filtered and regulated output voltage of the alternator.

FIGS. 5*a* through 5*e* show the output voltage wave form of one of the stator windings 80, 82, 84 of the alternator 64 during various stages of operation. FIG. 5*a*, for example, shows the normal output of a stator winding of the alternator 64 over time when there is no braking. A continuous alternating current sine wave 202 is the typical waveform during this stage of operation. The voltage produced is rectified by diodes 88 and regulated by voltage regulator 90 as described above to produce a constant DC voltage output 209 as shown in FIG. 5*e*.

During heavy braking or a high flow rate, the sine wave 202 is interrupted as shown in FIG. 5*b*. The resulting waveform 203 is a series of pulses 204, 206, 208, 210, etc. having varying amplitudes. The width of the pulses represents the time during which the alternator is generating power for the control and sensor electronics and charging the capacitor 92. The spaces 212, 214, 216, etc., between the pulses 204, 206, 208, 210, etc., represent the time during which braking is effected by shorting the stator winding of the alternator. As seen in FIG. 5*b*, during heavy braking (often due to a high flow rate), the pulses 204, 206, 208, 210, etc., are relatively narrow and the spaces 212, 214, 216, etc., between the pulses 204, 206, 208. 210, etc., are relatively wide, indicating that the stator winding is being shorted for longer periods of time. Comparing FIG. 5*c*, it will be appreciated that during light braking (often due to a low flow rate), the pulses 204, 206, 208, 210, etc., are relatively wide and the spaces 212, 214, 216, etc., between the pulses 204, 206, 208, 210, etc., are relatively narrow, indicating that the stator winding is being shorted for shorter periods of time. This results in a slightly different waveform 205.

It will be appreciated that even during heavy braking, there will be periods when voltage generated by the alternator is rectified by diodes 88 to produce the waveform 207 shown in FIG. 5*d*. It will further be appreciated that during the braking intervals 212, 214, 216, etc., the capacitor 92 discharges and supplements the voltage generated by the alternator and thus the regulated voltage output from the voltage regulator 90 is a continuous DC voltage 209 as shown in FIG. 5*e*.

There has been described and illustrated herein an integrated modulator and turbine-generator for use in an MWD tool. While particular embodiments of the invention have been described, it is not intended that the invention be limited thereto, as it is intended that the invention be as broad in scope as the art will allow and that the specification be read likewise. Thus, while a particular gear ratio has been disclosed for coupling the alternator to the drive shaft, it will be appreciated that other gear ratios could be utilized. Also, while a three phase alternator has been shown, it will be recognized that other types of alternators or braking devices could be used with similar results obtained. In addition, while the braking circuit has been show with individually controlled FETs for selectively shorting each of three stator windings, it will be understood that the stator windings could be shorted simultaneously. Furthermore, it will be appreciated that the inventive concept of a combination turbine-modulator-braking device may be applied to hydraulic or hydromechanical braking devices in lieu of an electrical braking device. In the case of electrical braking devices, these may include permanent magnet devices, electromagnetic induction devices, eddy current dissipation devices, disks, resistors and semiconductors. In the case of non-electrical braking devices, these may include pumps, fans, and fluid shear devices. Moreover, while particular configurations have been disclosed in reference to the impeller, the modulator rotor, and the modulator stator, it will be appreciated that other configurations could be used as well. Furthermore, while the invention has been disclosed as having a flow sleeve with an annular passage of varying width, it will be understood that different arrangements can achieve the same or similar function as disclosed herein. It will therefore be appreciated by those skilled in the art that yet other modifications could be made to the provided invention without deviating from its spirit and scope as so claimed.

We claim:

1. An apparatus for use in a borehole having borehole fluid flowing therethrough, said apparatus comprising:

a) a tool housing having an open end for receiving the borehole fluid;

b) a drive shaft mounted for rotation in said housing;

c) a turbine impeller mechanically coupled to said drive shaft such that the flowing borehole fluid causes said turbine impeller to rotate;

d) a modulator rotor mechanically coupled to said drive shaft such that rotation of said turbine impeller causes said modulator rotor to rotate;

e) a modulator stator mounted in said housing adjacent said modulator rotor such that rotation of said modulator rotor relative to said modulator stator creates pressure pulses in the borehole fluid; and f) a controllable braking means for selectively braking rotation of said modulator rotor to modulate said pressure pulses.

2. An apparatus according to claim 1, further comprising:

g) an alternator coupled to said drive shaft, said alternator having at least one stator winding.

3. An apparatus according to claim 2, wherein:

said controllable braking means comprises a control circuit coupled to said at least one stator winding for selectively shorting said at least one stator winding to electromagnetically brake said alternator and thereby selectively brake rotation of said modulator rotor to modulate said pressure pulses.

4. An apparatus according to claim 3, further comprising:

h) gear means coupled between said drive shaft and said alternator for causing said alternator to rotate faster than said drive shaft.

5. An apparatus according to claim 4, wherein:

said gear means has a ratio of substantially 14:1.

6. An apparatus according to claim 3, further comprising:

h) tachometer means coupled to one of said alternator and said drive shaft and coupled to said control circuit for determining rotational speed of said alternator.

7. An apparatus according to claim 6, wherein:

said tachometer means is a Hall effect sensor.

8. An apparatus according to claim 3, wherein:

said alternator is a three phase alternator having three stator windings.

9. An apparatus according to claim 3, wherein:

said control circuit includes oscillator means for producing a carrier frequency upon which said pressure pulses are modulated.

10. An apparatus according to claim 9, wherein:

said pressure pulses are modulated according to a frequency shift keying (FSK) scheme.

11. An apparatus according to claim 6, wherein:

said control circuit comprises oscillator means for providing a constant reference frequency;

selectable divider means coupled to said oscillator means for selectably dividing said constant reference frequency to produce a desired output frequency;

frequency comparator means coupled to said divider means and to said tachometer means for comparing said rotational speed of said alternator with said desired output frequency; and pulse width modulator means coupled to said frequency comparator means and to said at least one stator winding of said alternator for selectively shorting said at least one stator winding so that said rotational speed is equal to said desired output frequency.

12. An apparatus according to claim 11, wherein:

said selectable divider means is coupled to a sensor means for sensing conditions in said borehole and providing output data to said selectable divider.

13. An apparatus according to claim 12, wherein:

said output data is binary coded data.

14. An apparatus according to claim 13, wherein:

said desired output frequency is varied between two predetermined frequencies.

15. An apparatus according to claim 14, wherein:

said rotational speed of said alternator is varied between substantially 7,100 and 8,000 RPM.

16. An apparatus according to claim 14, wherein:

said two predetermined frequencies are located substantially between 15 and 20 Hz.

17. An apparatus according to claim 3, further comprising:

h) electrical power storage means coupled to said at least one stator winding and to said control circuit, wherein said alternator charges said electrical power storage means and provides power for said control circuit when said at least one stator winding is not shorted, and said electrical power storage means provides power for said control circuit when said at least one stator winding is shorted.

18. An apparatus according to claim 17, wherein:

said electrical power storage means is a capacitor.

19. An apparatus according to claim 12, further comprising:

i) electrical power storage means coupled to said at least one stator winding and to said control circuit, wherein said alternator charges said electrical power storage means and provides power for said control circuit and said sensor means when said at least one stator winding is not shorted, and said electrical power storage means provides power for said control circuit and said sensor means when said at least one stator winding is shorted.

20. An apparatus according to claim 3, further comprising:

h) a pressure compensator mounted adjacent said alternator, wherein said tool housing is filled with oil and said pressure compensator provides room for expansion and contraction of said oil in response to temperature and pressure changes in the borehole.

21. An apparatus for use in a borehole having borehole fluid flowing therethrough, said apparatus comprising:

a) a tool housing having an open upper end for receiving the borehole fluid;

b) a drive shaft mounted for rotation in said housing;

c) a turbine impeller mechanically coupled to said drive shaft and facing said open upper end such that the flowing borehole fluid causes said turbine impeller to rotate;

d) a modulator rotor mechanically coupled to said drive shaft downstream from said turbine impeller such that rotation of said turbine impeller causes said modulator rotor to rotate;

e) a modulator stator mounted in said housing adjacent said modulator rotor such that rotation of said modulator rotor relative to said modulator stator creates pressure pulses in the borehole fluid; and f) a controllable braking means for selectively braking rotation of said modulator rotor to modulate said pressure pulses.

22. An apparatus according to claim 1, further comprising:

g) an alternator coupled to said drive shaft.

23. A method for modulating a pressure wave in a flow path of drilling fluid being circulated in a borehole, said method comprising:

a) providing a turbine impeller in the flow path of the drilling fluid so that the circulation of the drilling fluid imparts rotation to said turbine impeller;

b) mechanically coupling a modulator rotor to the impeller in the flow path so that rotation of said turbine impeller causes rotation of said modulator rotor;

c) providing a modulator stator adjacent said modulator rotor so that rotation of said modulator rotor relative to said modulator stator interrupts the circulation of the drilling fluid and produces the pressure wave in the flow path of the drilling fluid; and d) selectively braking rotation of said modulator rotor to modulate the pressure wave in the flow path of the drilling fluid.

24. A method according to claim 23, further comprising:

e) coupling an alternator to said modulator rotor, said alternator having at least one stator winding.

25. A method according to claim 24, further comprising:

f) monitoring the speed of rotation of said alternator; and g) selectively shorting said at least one stator winding to brake said alternator to a desired speed of rotation.

26. A method according to claim 24, further comprising:

f) monitoring the speed of rotation of said alternator;

g) selecting two desired speeds of rotation for said alternator; and h) selectively shorting said at least one stator winding to brake said alternator to one of said two desired speeds of rotation.

27. A method according to claim 26, wherein:

said selective shorting of said at least one stator winding is in response to binary data;

said alternator is braked to one of said two desired speeds in response to a binary 0; and said alternator is braked to the other of said two desired speeds in response to a binary 1.

28. A method according to claim 26, wherein:

said two desired speeds differ by at least approximately 10 percent.

* * * * *